US005685635A

United States Patent [19]

Barthelmess

[11] Patent Number: 5,685,635

[45] Date of Patent: Nov. 11, 1997

[54] DECORATIVE LIGHTING SYSTEM FOR INDOOR AND OUTDOOR USE

[75] Inventor: Peter Barthelmess, New Hempstead, N.Y.

[73] Assignee: Barcana, Inc., Grenby, Canada

[21] Appl. No.: 495,240

[22] Filed: Jun. 26, 1995

Related U.S. Application Data

[63] Continuation-in-part of Ser. No. 310,225, Sep. 21, 1994, abandoned.

[51] Int. Cl.[6] ..... F21V 3/00; H01R 33/00

[52] U.S. Cl. ..... 362/249; 362/123; 362/391; 362/368; 362/806; 362/252

[58] Field of Search ..... 362/363, 806, 362/807, 808, 249, 252, 391, 226, 368, 251, 253, 457, 237, 238, 439, 437, 433, 438, 396, 294, 373; 439/611, 619, 558

[56] References Cited

U.S. PATENT DOCUMENTS

| | | | |
|---|---|---|---|
| 2,027,156 | 1/1936 | Dupler | 362/437 |
| 2,233,486 | 3/1941 | Portnow | 362/226 |
| 2,339,385 | 1/1944 | Dupler | 362/363 |
| 3,253,137 | 5/1966 | Richter, III | 362/249 |
| 4,479,173 | 10/1984 | Rumpatis | 362/363 X |
| 4,670,822 | 6/1987 | Baker | 362/226 |
| 4,822,302 | 4/1989 | Dorleans | 362/226 X |
| 5,122,942 | 6/1992 | Lee | 362/439 X |
| 5,361,192 | 11/1994 | Lai | 362/123 |
| 5,483,432 | 1/1996 | Wang | 362/363 X |

*Primary Examiner*—Thomas M. Sember
*Attorney, Agent, or Firm*—Richard B. Klar, Esq.

[57] ABSTRACT

The present invention relates to an indoor and an outdoor decorative lighting system. The invention includes a lighting string, preferably of 18 light bulbs and a plug for putting into an outlet, a number of globes, preferably made of plastic and each having one of a variety of colors, and connecting elements for connecting the light bulbs to an opening in the globe. The connecting members have external elements for engaging internal lip in the sleeve shaped opening of the globe and internal rib members for engaging and securing the light bulb in place within the connecting member.

46 Claims, 6 Drawing Sheets

DECORATIVE LIGHTING SYSTEM FOR INDOOR AND OUTDOOR USE

BACKGROUND OF THE INVENTION

1. Field of the Invention

The present application is a continuation-in-part of U.S. patent application, Ser. No. 08/310,225 now abandoned filed on Sep. 21, 1994 and claims the benefits of priority pursuant to 35 U.S.C. Section 120 thereunder. The present invention relates to a decorative lighting system for indoor and outdoor use. In particular, the present invention relates to a lighting system that includes a lighting strip including a series of small light bulbs strung on a wire, colored globes with a sleeve shaped opening, connecting members for insertion and of the sleeve shaped opening of the globes wherein the connecting members are adapted to accept and engagingly hold the small light bulbs when inserted therein to effectively secure the light bulbs in the globes.

2. The Prior Art

Lighting systems are known in the prior art. However, it would be advantageous to provide globe-shaped bulbs of different colors into which bulbs of a light string can be inserted without risk of the light bulbs falling out no matter how the lighting system is strung or placed. It would be advantageous to use such a lighting system to decorate an outside patio area. It would also be advantageous to decorate other objects such as vertically standing poles or christmas trees, real or artificial ones.

SUMMARY OF THE INVENTION

It is a principle object of the invention to provide a decorative lighting system that is easy to assemble, colorful and which holds the light bulbs of the lighting string firmly in place in the globes even when moved around.

It is a further object to provide drainage means for any water that seeps into the globes.

Further objects will became more readily apparent in the description and drawings provided.

DETAILED DESCRIPTION OF THE DRAWINGS

Figure 1:
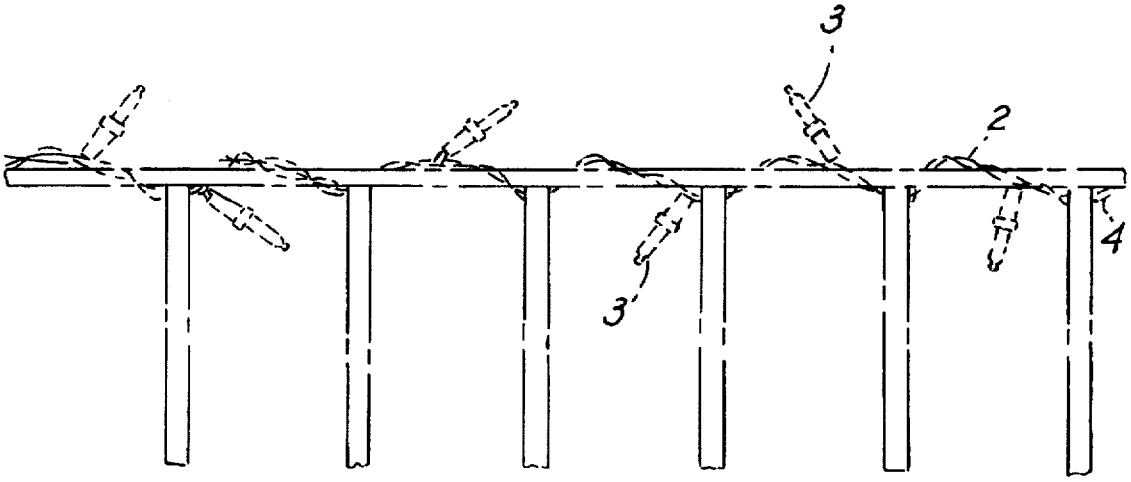
FIG. 1 is a side view showing the lighting system strung along the balcony rail of an outdoor patio.

Referring now to the drawings and in particular FIGS. 1 through 9, FIG. 1 shows the present invention 1 in an uncompleted state where a portion of the lighting string 2 is shown which contains a plurality of light bulbs 3 with the lighting string 2 being wrapped about a railing of a patio deck. In addition the lighting string can be placed on, hung from or wrapped around any object such as a boat, a ceiling, shrubbery, a bush, a vertically standing pole or a christmas tree and thus decorate these objects. Once the lighting string 2 is placed on or wrapped around these objects the bulbs 3 of the lighting string 2 can be inserted into the connecting members 8 and globes 5 and the securing means 101 can be latched in to the connecting members 8 so that the globes 5 will not separate from the bulbs 3 of the lighting string 2 and thus the decorative lighting system 1 will stay in place. Alternatively, the decorative lights 1 can first be assembled by connecting the bulbs 3, globes 5 and connecting members 8 and then placing, hanging or wrapping the lighting string 2 on the object to be decorated.

In an outdoor environment where it is windy, the securing means and the connecting members 8, as described below, prevent any of the globes 5 from dislodging from bulbs 3 of the lighting string 2, and the connecting members 8 from dislodging from the globes 5 due to the wind.

Figure 2:
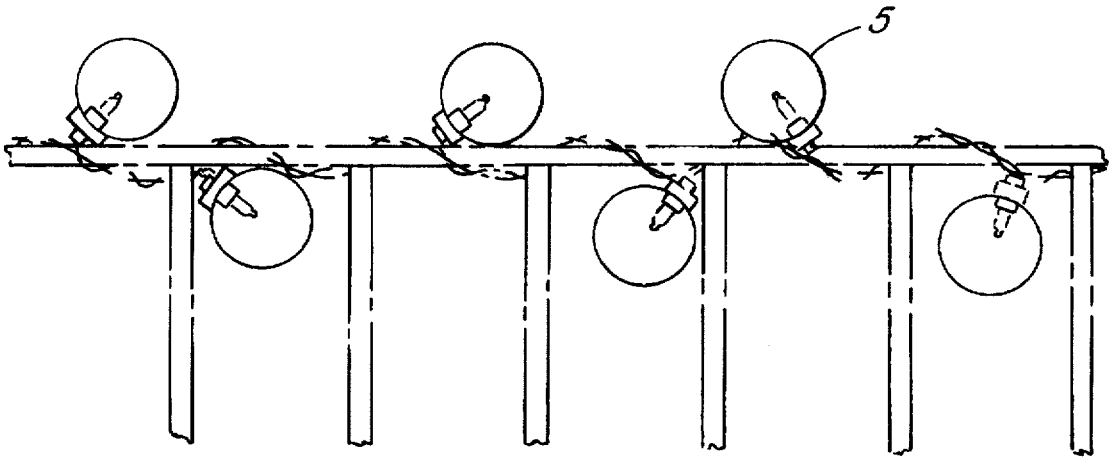
FIG. 2 is the lighting system of FIG. 1 with the present invention fully assembled with the globes, connecting members and the lighting string.

FIG. 2 shows the present invention 1 in the completed state where the light bulbs 3, by means of respective connecting members 8, are inserted and firmly engaged within respective color globes 5. Each of the globes 5 may be preferably made of plastic material and of a separate color such as yellow or green or blue so that a variety of lighted color globes 5 decorate the railings of an outside patio deck.

Figure 3:
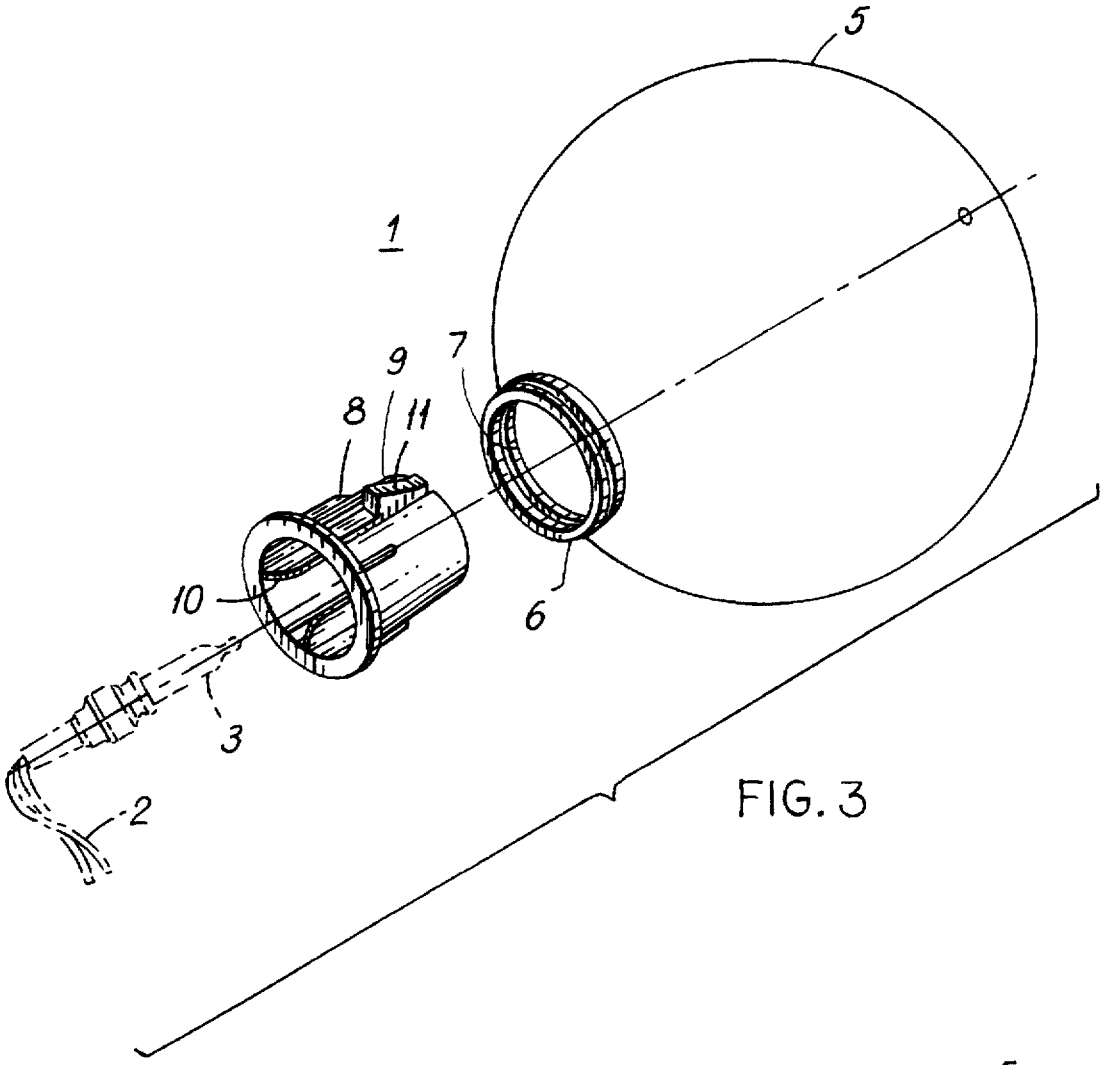
FIG. 3 is an exploded prospective view of a part of the present invention showing a globe, connecting member, and a light bulb of a lighting string.
Figure 4:
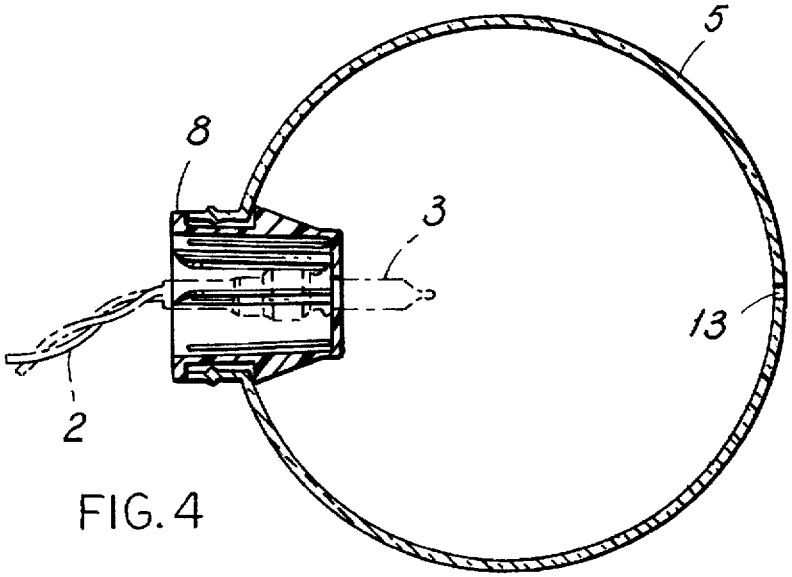
FIG. 4 is an assembled view of FIG. 3 showing a globe, a connecting member and a light bulb fully assembled.

FIG. 3 is a perspective exploded view showing how a light bulb 3 is inserted into the connecting member 8 which in turn is inserted into the sleeve shaped opening 6 of a globe 8 of the present invention. As can be seen, internal rib members 10 in the connecting member 8 fittingly accommodate a light bulb 3 within the connecting member 8 and the external rib members 11 are engaged in the internal circular lip 7 of the sleeve shaped opening of the globe 5, as can be seen in FIGS. 3 and 4.

Figure 5:
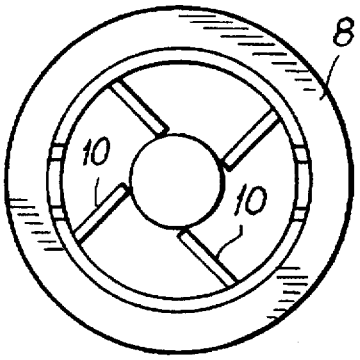
FIG. 5 is a bottom view of the connecting member of the present invention.
Figure 6:
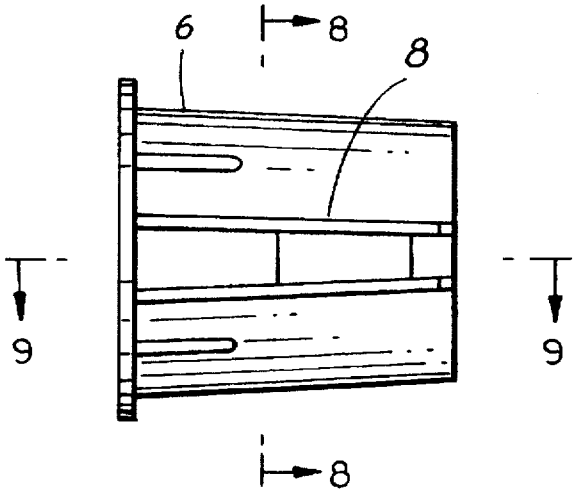
FIG. 6 is a side view of the connecting member of the present invention.
Figure 7:
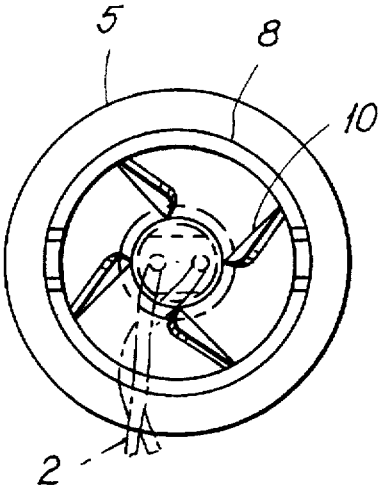
FIG. 7 is the bottom view of the connecting member as it is inserted into a globe and a light bulb of a lighting string is inserted into a connecting member.
Figure 8:
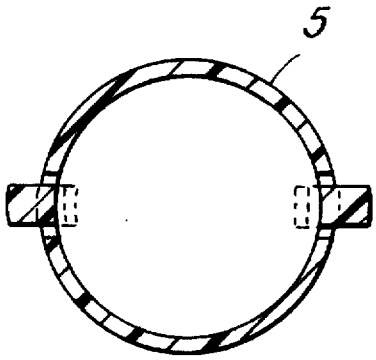
FIG. 8 shows the sleeve engaging opening of the globe.

As is clear from FIG. 5, it is preferable to make four internal rib members 10 for the connector angled and distributed in the positions shown in FIG. 5. This can also be seen in the sectional view in FIG. 6. The light bulb 3 can be inserted as shown in FIG. 7 into the connecting member 8 which in turn is fitted to the globe a as shown in FIGS. 7 and 8.

Figure 9:
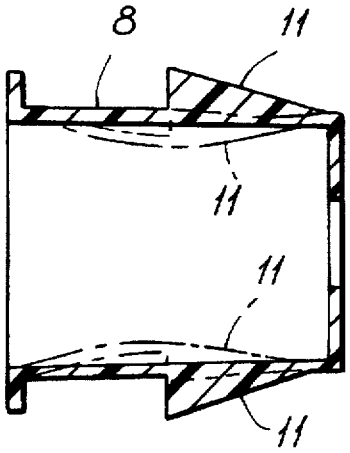
FIG. 9 shows the external ribs of a connecting member in both a flexed state (in dashed lines) and in an un-flexed state (in solid lines) for engagement in the sleeve engaging opening of the globe.

As is clear from FIG. 9, the external rib members 11 are flexible and can bend or flex to engage the internal lip 7 of the globe 5. Members 11 are preferably made so that once the connecting member is inserted into the globe 5 the members 11 expand so that they cannot contract when attempting to pull the connecting member 8 out of the globe 5, as shown in FIG. 9. Thus the connecting member 8 permanently seals the connecting member 8 into the globe 5 ensuring that the connecting member 8 will not dislodge from the globe 5.

The lighting string 2 itself is preferably made to accommodate 18 light bulbs 3 which can be evenly distributed along the string and also to provide a plug at one end of the lighting string 2 for plugging into an electric socket. Such lighting strings of this type can be obtained from companies such as Miniami National Corporation and are manufactured by Golden Shine Electric Company, Ltd. In the present invention the lighting string is preferably manufactured in the prese with a 6" lead and have 12" spacing between light bulbs for a lighting string of 18 light bulbs and an end to end connector for an electrical plug. Of course, it is understood that the number of lights can vary and the present application is not limited to any one particular kind of light.

The globes 5 are preferably made of plastic materials and are preferably spherically shaped. They have an opening 6 at one end with an internal lip 7 as described above for engaging connecting with the connecting member 8 in order to provide a means for fastening the connecting member 8 to the globe 5 and in turn permitting the light bulb 3 of the lighting string 2 to be fittingly connected within the globe 5. The globe 5 preferably also has at its bottom surface a small hole 13 so that any water due to rain fall, etc which should seep through the sleeve shaped opening of the globe can be drained.

The connecting member is preferably made by injection molding in one piece, and of plastic material. There are preferably four internal rib members 10 which are flange shaped and preferably have a rounded shoulder at one end coming off the longitudinal body of the cylindrically shaped connecting member 8. The connecting member 8 also has preferably two external rib like members 11 for engaging the internal lip 7 of the sleeve shaped opening 6 of the globe 5. It is preferable to manufacture this device with 18 light bulbs 3 on a wiring string 2 and 18 globes 5 of various colors such as red, blue, green, yellow and orange. Also, 18 connecting members 8 would be needed, one for each light bulb 3 and for each globe 5.

Figure 11:
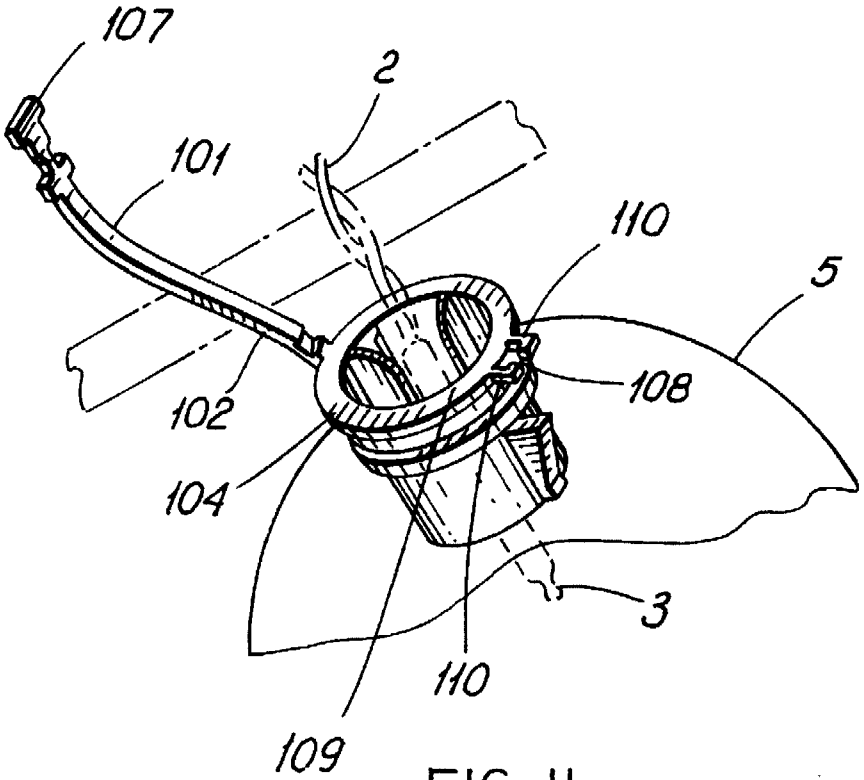
FIG. 11 is the same embodiment as shown in FIG. 10 showing the securing member in the open position.
Figure 10:
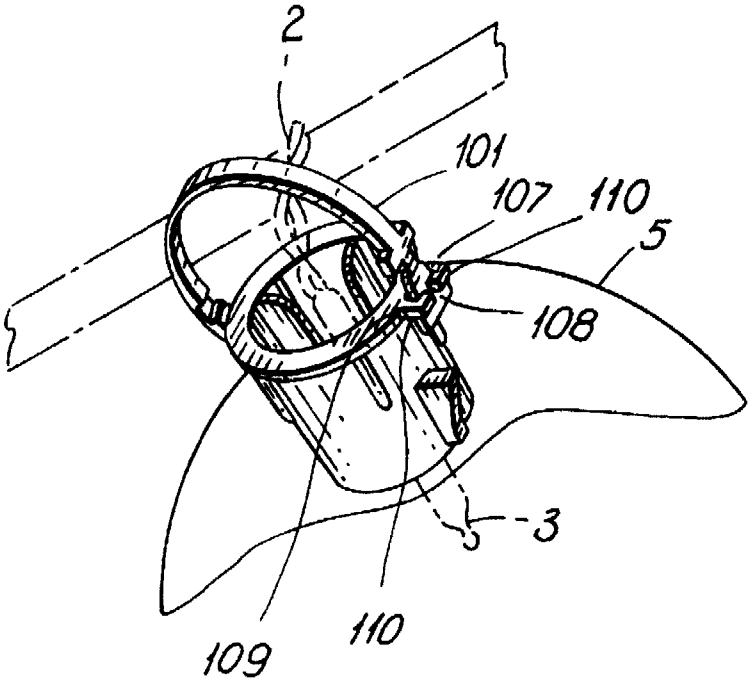
FIG. 10 is a partial perspective view of another embodiment of the present invention in which a securing member is provided and shown in the closed position fastened to the connecting member to securingly guard the bulb from falling out of the globe.

The connecting member 8 preferably also has a securing member 101 or means shaped as a longitudinal strip 102 and connected at one end 103 to a side 104 of the connecting member 8 and having at its other end 106 a latch 107 that engages a groove 108 on the other side 109 of the connecting member 9 so as to lockingly secure a light bulb 3 that has been inserted into the connecting member 8 and respective globe 5, as seen in FIGS. 10 and 11. The groove 108 is preferably formed by two L shaped arms 110 on said other side 109 of the connecting member 8. The securing member 101 prevents each of the globes 5 from falling off of the respective bulbs 3 of the lighting string 2 and thus acts as a guard for keeping each globe 5 over each of the bulb 3 of the lighting string 2 (see FIG. 10). The securing member 101 and the two L shaped arms 110 are preferably formed as part of the connecting member 8 by injection molding and are preferably made of plastic material.

For use on a patio deck such as on a railing as shown in FIG. 1, the lighting string 3 can first be mounted and wrapped as preferred and then the connecting members and globes can be affixed to each of the light bulbs 3 on the lighting string 2. If preferred, these three components, the globe 5, the light bulb 3 and the connecting member 8 can be connected first and the entire decorative lighting system 1 can be either hung, placed on or wrapped about the rail. This decorative lighting system 1 can be used to decorate an outdoor patio deck and also internally to decorate a room in one of many ways including by hanging, placing the decorative lighting system 1 thereon or by wrapping. This decorative lighting system 1 provides for a colorful, decorative and-aesthetically pleasing decoration of exterior and interior areas. It is understood that the invention is not limited to globe shaped bulbs 5 or to any particular number or colors of the globes 5.

Figure 12:
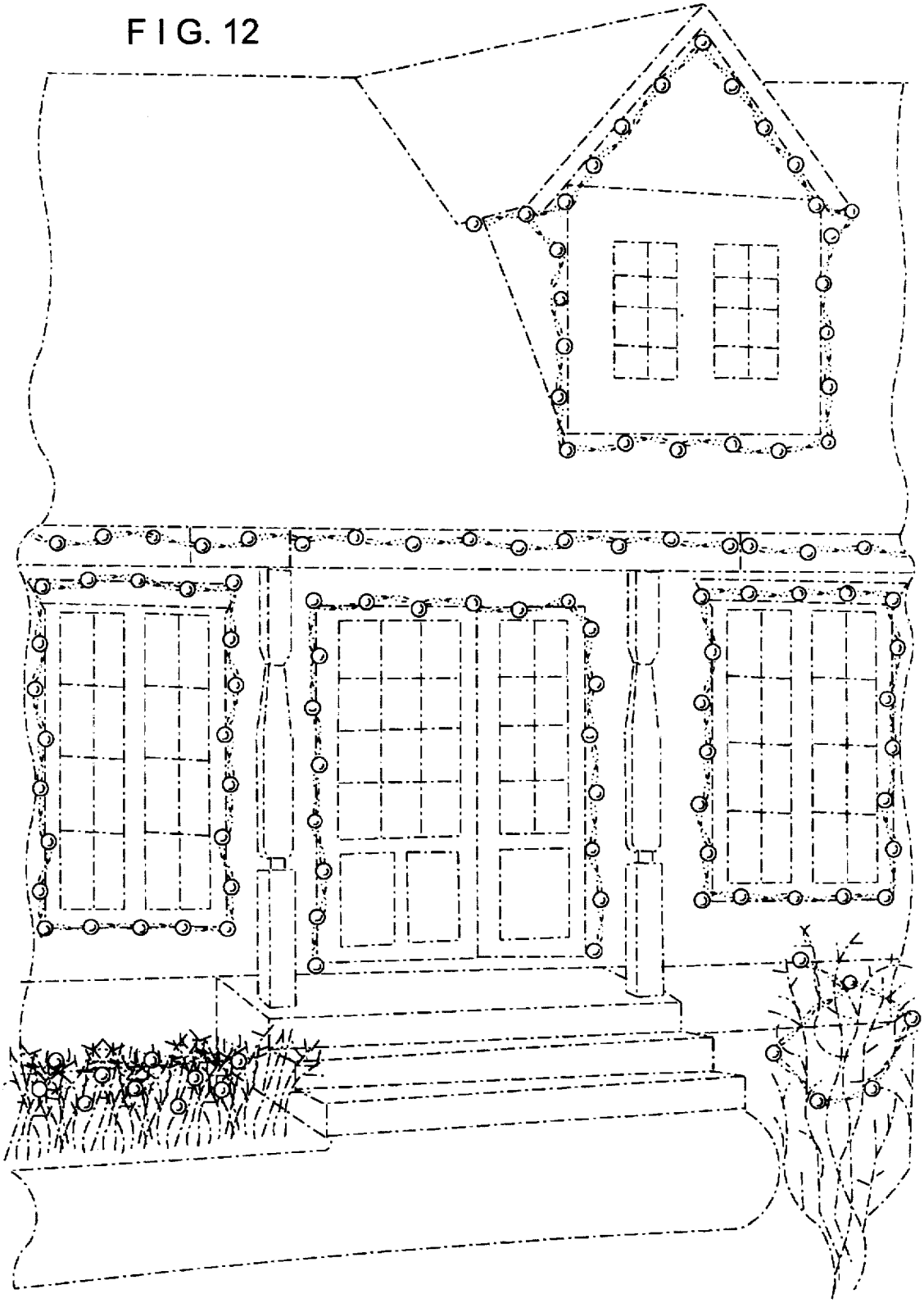
FIG. 12 shows the present invention decorating a shrub or bush.
Figure 15:
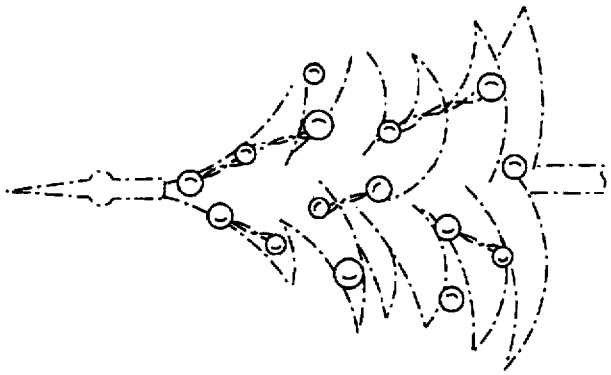
FIG. 15 shows the present invention decorating a christmas tree.
Figure 14:
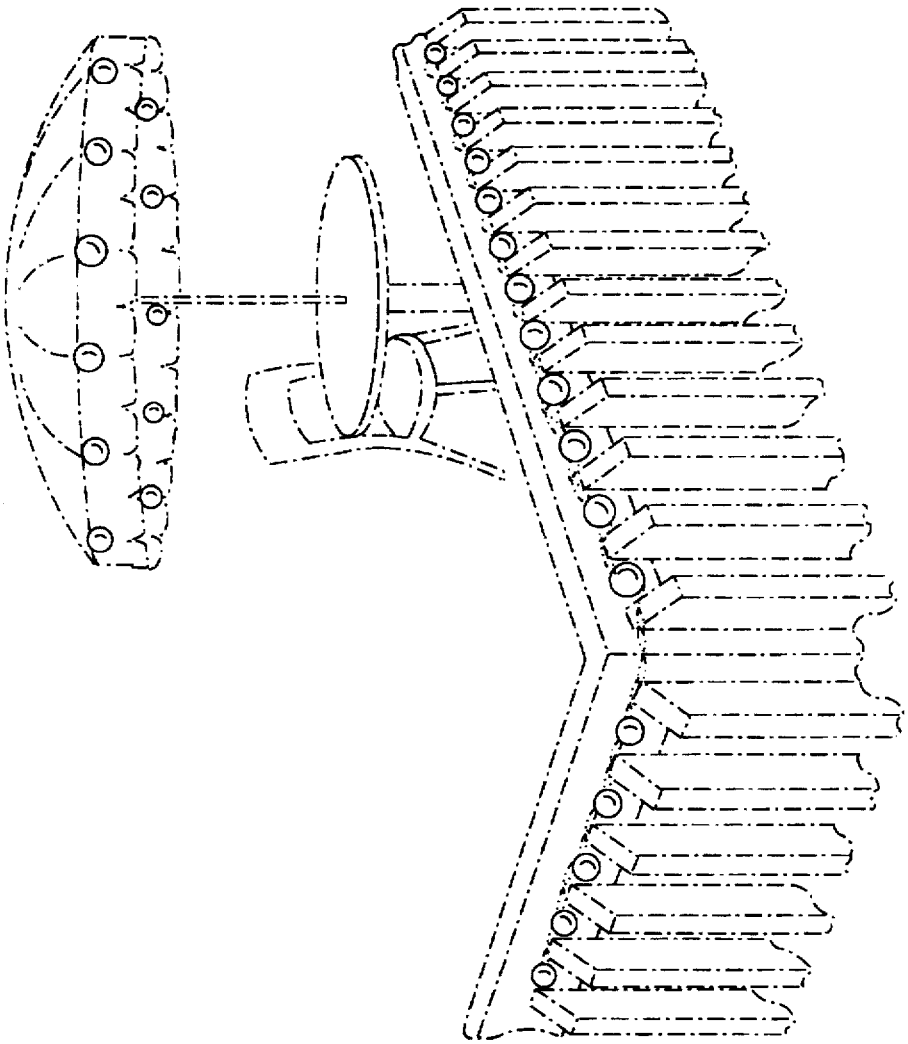
FIG. 14 shows the present invention decorating an umbrella.
Figure 13:
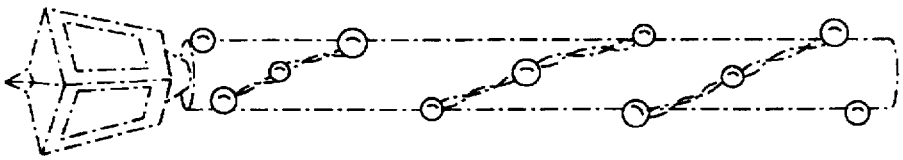
FIG. 13 shows the present invention decorating a pole.

The decorative lighting system 1 can also be interlaced with either artificial or real greenery to enhance its decorative appeal. The decorative lighting system I can also be used to decorate a variety of areas such as shrubbery, hedges, ceilings and any other objects. For example FIG. 12 shows a bush 200 decorated by the decorative lighting system and its globes 5. Similarly, FIG. 13 shows a pole 210 decorated with the globes 5. FIG. 14 shows an umbrella 220 decorated with the globes 5. FIG. 15 shows a Christmas tree 230 decorated with the globes 5.

I do not limit myself to any particular details of construction set forth in the specification and illustrated in the accompanying drawings, as the same refers to and sets forth only certain embodiments of the invention, and it is observed that the same may be modified without departing from the spirit and scope of the claimed invention.

Having thus described the invention, what is claimed as new and desired to be secured by Letters Patent is as follows:

1. A decorative lighting system comprising a lighting string including a plurality of light bulbs secured to a wire at spaced intervals along the wire;

a plurality of housings each having an opening, each opening having an internal rimmed lip;

connecting members each having an interior surface and an exterior surface and each having external rib members for engaging each said lip of said housings and internal rib members which are flexible for engaging each light bulb inserted to one of said connecting members, said external rib members disposed on said exterior surface of each said connecting members and said internal rib members disposed on said interior surface of said connecting members.

2. The decorative lighting system according to claim 1 wherein said external rib members of each said connecting members expand upon insertion into each of said globes so as to permanently lock each of said connecting members into each of said housing.

3. The decorative lighting system according to claim 1 further comprising securing means connected to said connecting members, said securing means being adapted to lockingly secure said housing to said bulbs of said lighting string.

4. The decorative light system in claim 1 wherein said securing means are each formed as longitudinal strips attached at one end to a side of said connecting member and being engagably attached to an opposite side of said connecting member after a light bulb is inserted in said connecting member.

5. The decorative light system in claim 4 wherein said longitudinal strip is integrally formed at said one side of said connecting member and has a latching member that is adapted to engage a groove in said opposite side of said connecting member so that said longitudinal strip extends across the opening of said connecting member and said housing into which said light bulb has been inserted.

6. A decorative lighting system as claimed in claim 1 wherein each said housing has a hole at its bottom surface for permitting accumulated water to drain therethrough.

7. A decorative lighting system according to claim 1, wherein said connecting member each have four internal rib members to engage a light bulb of said lighting string.

8. A decorative lighting system according to claim 1, wherein said housings are formed of plastic material and each housing having a different color from the other globes.

9. A decorative lighting system according to claim 1, wherein said external ribs member of said connecting member are flexible and are flexed enabling insertion into said opening of housing.

10. A decorative lighting system according to claim 1, wherein said external rib members are two and are located on opposite sides of said connecting member.

11. A decorative lighting system according to claim 1, wherein each said connecting member is formed by injection molding and made of plastic material and has a generally global shape with a opening at its top and bottom surface.

12. A decorative lighting system according to claim 1, wherein said lighting system includes 18 light bulbs evenly spaced along said wire and 18 globes of various colors and 18 connecting members.

13. The decorative lighting system of claim 1 wherein said decorative lighting system is decoratively placed on a ceiling.

14. The decorative lighting system according to claim 1 wherein said decorative lighting system decorates a shrubbery.

15. The decorative lighting system according to claim 1 wherein said decorative lighting system decorates a bush.

16. The decorative lighting system according to claim 1 wherein said lighting string is interlaced with shrubbery to enhance the decorative nature of the decorative lighting system.

17. The decorative lighting system according to claim 1 wherein said decorative lighting system is wrapped around an object it decorates.

18. The decorative lighting system according to claim 1 where said housings are globes.

19. In combination, a decorative lighting system and a patio deck comprising a lighting string including a plurality of light bulbs secured to a wire at spaced intervals along the wire;

a plurality of housings each having an opening, each opening having an internal rimmed lip; connecting members each having an interior surface and an exterior surface and each having external rib members for engaging each said internal lip of said housings upon insertion into said housings and internal rib members which are flexible for engaging each light bulb inserted to a one of said connecting members said external rib members disposed on said exterior surface of each said connecting members and said internal rib members disposed on said interior surface of said connecting members; and the patio deck wherein said decorative lighting system is decoratively placed thereon.

20. The combination according to claim 19 further comprising securing means connected to said connecting members, said securing means being adapted to lockingly secure said housings into to said bulbs of said lighting string.

21. The combination in claim 19 wherein said securing means are each formed as longitudinal strips attached at one end to a side of said connecting member and being engagably attached to an opposite side of said connecting member after a light bulb is inserted in said connecting member.

22. The combination according to claim 21 wherein said longitudinal strip is integrally formed at said one side of said connecting member and has a latching member that is adapted to engage a groove in said opposite side of said connecting member so that said longitudinal strip extends across the opening of said connecting member and said housing into which said light bulb has been inserted.

23. The combination according to claim 19 wherein each said housing has a hole at its bottom surface for permitting accumulated water to drain therethrough.

24. The combination according to claim 19, wherein said connecting member each have four internal rib members to engage a light bulb of said lighting string.

25. The combination according to claim 19, wherein said housing are formed of plastic material and each housing having a different color from the other globes.

26. The combination according to claim 19, wherein said external ribs member of said connecting member are flexible and are flexed enabling insertion into said opening of housing.

27. The combination according to claim 19, wherein said external rib members are two and are located on opposite sides of said connecting member.

28. The combination according to claim 19, wherein each said connecting member is formed by injection molding and made of plastic material and has a generally global shape with a opening at its top and bottom surface.

29. The combination according to claim 19, wherein said lighting system includes 18 light bulbs evenly spaced along said wire and 18 globes of various colors and 18 connecting members.

30. The decorative lighting system according to claim 19 where said housings are globes.

31. In combination, a decorative lighting system and a vertically standing member comprising a lighting string including a plurality of light bulbs secured to a wire at spaced intervals along the wire;

a plurality of housings each having an opening, each opening having an internal rimmed lip;

connecting members each having an interior surface and an exterior surface and each having external rib members for engaging each said internal lip of said housings upon insertion into said housings and internal rib members which are flexible for engaging each light bulb inserted to a one of said connecting members, said external rib members disposed on said exterior surface of each said connecting members and said internal rib members disposed on said interior surface of said connecting members; and each of said connecting members having a bottom surface which is proximate to said bottom surface of each of said housings;

the vertically standing member wherein said decorative lighting system is decoratively wrapped thereabout.

32. The combination according to claim 31, further comprising securing means connected to said connecting members, said securing means being adapted to lockingly secure said housings to said bulbs of said lighting string.

33. The combination in claim 31, wherein said securing means are each formed as longitudinal strips attached at one end to a side of said connecting member and being engagably attached to an opposite side of said connecting member after a light bulb is inserted in said connecting member.

34. The combination according to claim 33, wherein said longitudinal strip is integrally formed at said one side of said connecting member and has a latching member that is adapted to engage a groove in said opposite side of said connecting member so that said longitudinal strip extends across the opening of said connecting member and said housing into which said light bulb has been inserted.

35. The combination according to claim 31, wherein each said housing has a hole at its bottom surface for permitting accumulated water to drain therethrough.

36. The combination according to claim 31, wherein said connecting member each have four internal rib members to engage a light bulb of said lighting string.

37. The combination according to claim 31, wherein said housings are formed of plastic material and each housing having a different color from the other housing.

38. The combination according to claim 31, wherein said external ribs member of said connecting member are flexible and are flexed enabling insertion into said opening of housing.

39. The combination according to claim 31, wherein said external rib members are two and are located on opposite sides of said connecting member.

40. The combination according to claim 31, wherein each said connecting member is formed by injection molding and made of plastic material and has a generally global shape with a opening at its top and bottom surface.

41. The combination according to claim 31, wherein said lighting system includes 18 light bulbs evenly spaced along said wire and 18 globes of various colors and 18 connecting members.

42. The decorative lighting system according to claim 31 where said housings are globes.

43. The combination according to claim 31 wherein said vertical standing member is a pole.

44. The combination according to claim 31 wherein said standing mechanism is an umbrella.

45. The combination according to claim 31 wherein said standing member is a christmas tree.

46. A decorative lighting system comprising a lighting string including a plurality of light bulbs secured to a wire at spaced intervals along the wire;

a plurality of housings each having a bottom surface having a lowest portion and an opening, each opening having an internal timed lip;

connecting members each having external rib members for engaging each said lip of said housings and internal rib members which are flexible for engaging each light bulb inserted to one of said connecting members, and each of said connecting members having a bottom surface which is disposed immediately below and makes contact with at least a portion of said lowest portion of said bottom of each of said housing.

* * * * *